United States Patent [19]

Lutz et al.

[11] 4,335,311

[45] Jun. 15, 1982

[54] X-RAY DIAGNOSTIC APPARATUS WITH AN IMAGE-INTENSIFIER TV CHAIN

[75] Inventors: Herbert Lutz, Seukendorf; Rolf Pfeifer, Erlangen, both of Fed. Rep. of Germany

[73] Assignee: Siemens Aktiengesellschaft, Berlin & Munich, Fed. Rep. of Germany

[21] Appl. No.: 164,053

[22] Filed: Jun. 30, 1980

Related U.S. Application Data

[63] Continuation of Ser. No. 969,193, Dec. 13, 1978, abandoned.

[30] Foreign Application Priority Data

Jan. 30, 1978 [DE] Fed. Rep. of Germany ..... 2803913

[51] Int. Cl.[3] ..... H05G 1/30

[52] U.S. Cl. ..... 250/409; 250/402

[58] Field of Search ..... 250/401, 402, 408, 409, 250/416 TV

[56] References Cited

U.S. PATENT DOCUMENTS 3,631,527 12/1971 Splain ..... 250/409

4,117,335 9/1978 Franke ..... 250/409

*Primary Examiner*—Craig E. Church

*Attorney, Agent, or Firm*—Hill, Van Santen, Steadman, Chiara & Simpson

[57] ABSTRACT

A control installation for the dose rate of the x-ray tube and, thus, for the mean brightness of the output image of the x-ray image intensifier is present. Further, switching circuitry is provided, by means of which a preprogrammed rated value for the dose rate is selected, which rated value lies below the dose rate required for a diagnosis.

1 Claim, 1 Drawing Figure

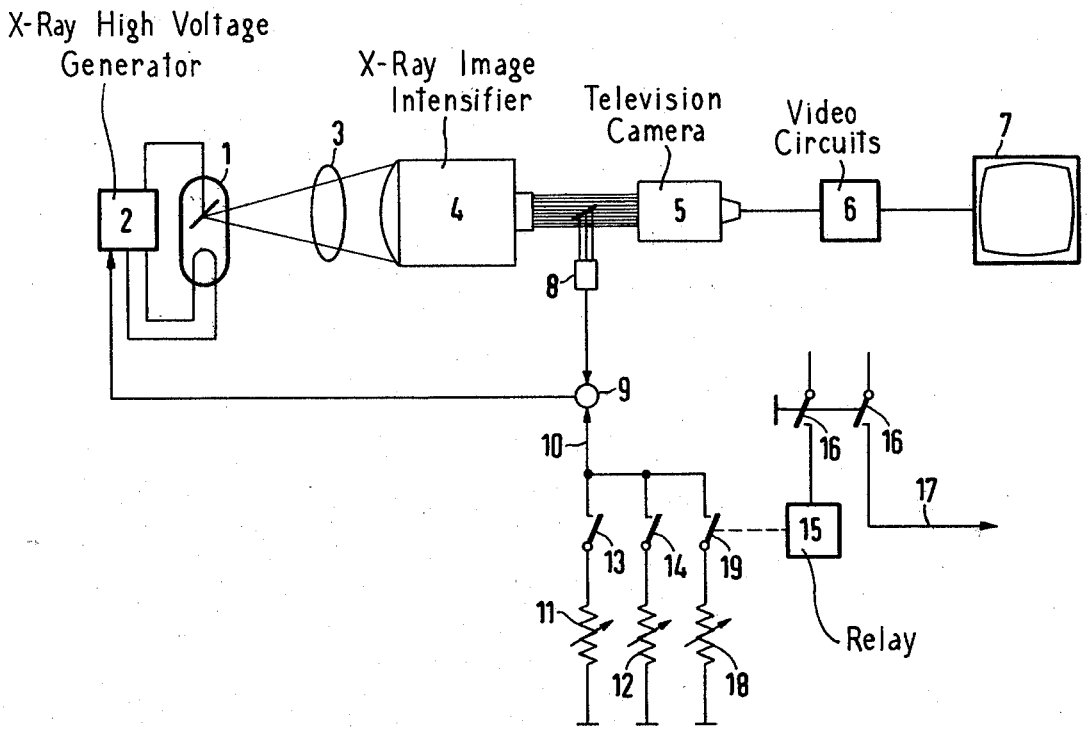
X-Ray High Voltage Generator
X-Ray Image Intensifier
Television Camera
Video Circuits
1
2
3
4
5
6
7
8
9
10
11
12
13
14
15
16
16
17
18
19
Relay

X-RAY DIAGNOSTIC APPARATUS WITH AN IMAGE-INTENSIFIER TV CHAIN

CROSS-REFERENCE TO RELATED APPLICATION

The present application is a continuation of my prior application U.S. Ser. No. 969,193 filed Dec. 13, 1978, which is to be abandoned in favor of the present application.

BACKGROUND OF THE INVENTION

The invention relates to an x-ray diagnostic apparatus with an image-intensifier-TV chain as well as a control installation for the dose rate of the x-ray tube and thus the mean brightness of the output image of the x-ray image intensifier.

An x-ray diagnostic apparatus of this type, for example, is described in U.S. Pat. No. 3,991,314. In such an x-ray diagnostic apparatus, the desired rated value for the dose rate of the x-ray tube is adjusted for an exposure. In so doing, in practice, only such dose rates are programmed as rated values, which allow a good diagnosis.

In an x-ray diagnostic apparatus of the type initially cited, the image-intensifier-TV chain is used not only for diagnosis but rather also for positioning the patient before an x-ray exposure. On the basis of the fluoroscopy image, the organs to be photographed can be correctly located very quickly reliably. By adjusting the patient with fluoroscopy monitoring, the occurrence of useless photographic exposures is avoided. The patient and the physician, thus, are less exposed to radiation than in the case of the adjustment of the patient for an x-ray photographic exposure without fluoroscopy monitoring, since in this case x-ray exposures must often be repeated.

Positioning the patient with fluoroscopy monitoring, however, also demands a certain dose, which leads to a certain exposure of the patient.

SUMMARY OF THE INVENTION

The object of the invention is to design an x-ray diagnostic apparatus of the type initially cited in such manner that the necessary radiation exposure for positioning the patient with fluoroscopy control is kept as minimal as possible.

This object is inventively achieved in that switching means are present, by means of which a preprogrammed rated value for the dose rate is adjustable, which lies below the dose rate required for a diagnosis. In the invention, one has proceeded from the viewpoint that, for positioning a patient with fluoroscopy monitoring, a dose rate is sufficient at which the quantum noise of the x-ray image intensifier becomes noticeable and the quality of the television image is not sufficient for a diagnosis. Even in the case of such a diminished image quality, a completely satisfactory adjustment of the patient is possible.

In the following, the invention is more closely explained on the basis of a sample embodiment illustrated in the accompanying sheet of drawings; and other objects, features and advantages will be apparent from this detailed disclosure and from the appended claims.

BRIEF DESCRIPTION OF THE DRAWING

The single FIGURE shows a diagram of an image intensifier-closed circuit television system in accordance with the present invention.

DETAILED DESCRIPTION

In the drawing, an x-ray tube 1 is illustrated, which is supplied by an x-ray high voltage generator 2. A patient 3 is irradiated by the x-ray radiation. The x-ray image is intensified by an x-ray image intensifier 4. The intensified x-ray image appearing on the output screen of the x-ray image intensifier 4 is picked up by a television camera 5 and reproduced on a viewing device 7 via video circuitry 6.

In order to hold the mean image brightness on the output screen of the x-ray image intensifier 4 constant, a photomultiplier 8 is provided as an actual value transmitter and is coupled to the light energy in the ray path between the x-ray image intensifier 4 and the television camera 5, which photomultiplier supplies a corresponding signal to the actual value input of a comparator 9. The comparator 9 exhibits a rated value input 10, at which there lies a signal that corresponds to the desired rated value of the mean image brightness on the output screen of the x-ray image intensifier 4 and, thus, corresponds with the desired dose rate. As a function of the difference between actual and rated value, the x-ray high voltage generator 2 is influenced in the sense of a conformation of the actual value to the rated value.

For adjusting the rated value, two rated value transmitters 11 and 12 are provided, by means of which, for example, rated values of 20 $\mu$R/s and 60 $\mu$R/s are adjustable. These rated values produce an image quality which permits a completely satisfactory diagnosis. The engagement of the rated value transmitters 11 and 12 ensues selectively via switches 13 and 14.

It is fundamental to the present invention, that a rated value transmitter 18 is provided, which is engageable by means of the contact 19 of a relay 15 and which prescribes a rated value of, for example, 5 $\mu$R/s, i.e., a rated value that produces an image quality which is no longer sufficient for a diagnosis, but which permits an adjustment of the patient with fluoroscopy monitoring. The low dose rate which is provided for the adjustment of the patient, produces a minimal radiation exposure during this adjustment.

The relay 15 is controlled by a hand switch 16, which is closed for the engagement of the fluoroscopy and simultaneously delivers a signal for this engagement to the circuit 17.

Of course, the hand switch 16 is only closed for the adjustment of a patient with diminished dose rate. For fluoroscopy undertaken for the purpose of a diagnosis, one of the rated value emitters 11 or 12 is engaged by means of one of the switches 13 or 14.

It will be apparent that many modifications and variations may be effected without departing from the scope of the novel concepts and teachings of the present invention.

We claim as our invention:

1. An x-ray diagnostic apparatus comprising:

(a) an x-ray source, (b) an x-ray high voltage generator for energizing said x-ray source to produce an x-ray beam with an input x-ray dose rate of adjustable value, (c) an x-ray image intensifier-TV chain comprising an x-ray image intensifier requiring an input x-ray dose rate above a predetermined value to provide an image quality suitable for medical diagnostic purposes, (d) dose rate sensing means for supplying an actual value signal in accordance with the actual value of the input x-ray dose rate supplied by said x-ray source to said x-ray image intensifier-TV chain, and (e) control means comprising comparator circuitry for connection with said x-ray high voltage generator for controlling the input x-ray dose rate to said x-ray image intensifier-TV chain and thus for controlling the mean brightness of the output from the x-ray image intensifier, (f) said control means comprising a plurality of rated value storage means (11, 12) for selectively supplying respective rated value signals to said comparator circuitry for selectively establishing respective input x-ray dose rate values greater than said predetermined value and selectively connectable with said comparator circuitry for controlling the input x-ray dose rate supplied to the x-ray image intensifier-TV chain in accordance with the respective rated value signal from a selected one of said rated value storage means, a further rated value storage means, (18) for selectively supplying a fixed rated value signal to said comparator circuitry, for selectively connectable with said comparator circuitry for selectively establishing an input x-ray rate at a preprogrammed fixed rated value less than said predetermined value required for a medical diagnosis but sufficient to provide an output image from said x-ray image intensifier-TV chain for purposes of visual observation to facilitate positioning a patient, and switching means (15, 16, 19) selectively operable for connecting said further rated value storage means (18) with said comparator circuitry for controlling the input dose rate supplied to said x-ray intensifier-TV chain in accordance with said preprogrammed fixed rated value, such that the patient can be positioned with the assistance of a visual observation of an x-ray generated image of the patient with minimal radiation exposure of the patient.

* * * * *